United States Patent [19]

Kiryu et al.

[11] 4,442,435

[45] Apr. 10, 1984

[54] GYRO STABILIZATION PLATFORM FOR SCANNING ANTENNA

[75] Inventors: Rikio Kiryu, Yokohama; Takeshi Bessho, Hachioji, both of Japan

[73] Assignee: Tokyo Shibaura Denki Kabushiki Kaisha, Kawasaki, Japan

[21] Appl. No.: 337,971

[22] Filed: Jan. 8, 1982

Related U.S. Application Data

[63] Continuation-in-part of Ser. No. 269,953, Jun. 3, 1981, abandoned.

[30] Foreign Application Priority Data

Jun. 3, 1980 [JP] Japan ..... 55-73710

[51] Int. Cl.[3] ..... H01Q 1/34; H01Q 1/18

[52] U.S. Cl. ..... 343/709; 343/765; 33/321

[58] Field of Search ..... 343/765, 766, 709; 33/318, 321

[56] References Cited

U.S. PATENT DOCUMENTS 4,193,308 3/1980 Stuhler et al. ..... 343/765

*Primary Examiner*—E. Lieberman

*Attorney, Agent, or Firm*—Finnegan, Henderson, Farabow, Garrett & Dunner

[57] ABSTRACT

A passive platform stabilization system is disclosed which is suitable for antenna stabilization in maritime communication systems. The stabilization system of the present invention comprises a platform rotatable in a horizontal plane. At least two gyros are suspended from the platform by suspension means which are rotatable about a vertical axis independent of the rotation of the platform in order to avoid undesirable torque components which would result from precession of the gyros. The platform pivots about axes which are parallel to the pitch and roll axes of a vessel on which it is mounted.

10 Claims, 4 Drawing Figures

12
72
30
28
59
10
19
20
16
55
70
63
61
36
58
22
44
62
54
60
51
40
34
50
42
15
38

GYRO STABILIZATION PLATFORM FOR SCANNING ANTENNA

This application is a continuation-in-part of application Ser. No. 06/269,953, filed June 3, 1981, now abandoned.

BACKGROUND OF THE INVENTION

The present invention relates to platform stabilization systems, and more particularly relates to an improvement in passive stabilization systems suitable for satellite tracking in maritime applications or the like.

Shipboard maritime communication systems impose many requirements on satellite tracking apparatus. Tracking antennas installed on the ship must first acquire the desired target satellite in stationary earth orbit. Once the target satellite has been acquired, the orientation of the antenna must be continually updated for changes in the ship's heading and the ship's position. This is accomplished by controlling the position of the antenna in the elevation and azimuth directions. Changes in the ship's heading are detected by a gyro compass. The platform supporting the antenna is usually automatically responsive to the gyro compass and driven in the azimuth direction in order to compensate for changes in the ship's direction. The ship's position changes are generally updated manually or automatically.

In maritime satellite communication systems, two primary ship motion disturbances, pitch and roll, must be considered. These motions require that the antenna control system automatically compensate for angular changes quickly and precisely in order to avoid excessive error in antenna orientation. Conventional passive antenna stabilization systems include two flywheels or gyros in order to attenuate roll and pitch motion independently. This is accomplished by allowing the gyros to precess through a limited angular displacement without disturbing the primary pitch or roll axis.

Examples of prior art passive stabilization systems are found in U.S. Pat. Nos. 4,020,491 and 4,118,707. U.S. Pat. No. 4,020,491 discloses a gyro stabilized platform having one or more gyros mounted below the platform. The pivot axes of the gyro mounts disclosed therein are always perpendicular to the gimbal axes supporting the pivoted platform. U.S. Pat. No. 4,118,707 discloses a similar arrangement having a mechanism for shifting the center of gravity of the platform in order to achieve rapid adjustment of the position of the antenna.

Conventional passive stabilization systems suffer from certain serious drawbacks when the directional orientation of the platform is altered during pitch and roll disturbances. If the platform is rotated about the azimuth axis during pitch or roll motion, the resulting precession of one of the gyro axes will result in a horizontal torque component in accordance with the right hand rule for gyroscopic precession. The horizontal torque component will tend to tilt the platform during this motion. This horizontal torque component of gyro angular momentum prevents precise stabilization of the antenna platform and causes excessive tracking errors.

It is therefore an object of this invention to improve upon passive stabilization systems and overcome these problems.

Another object is to compensate for undesired torque influence thus providing a precise passive stabilization system.

A further object is to improve passive antenna stabilization systems suitable for maritime satellite communication systems.

Yet another object of this invention is to eliminate undesired torque influence in passive antenna stabilization system suitable for maritime communication when adjusting the position of the antenna during pitch or roll motion of a vessel.

SUMMARY OF THE INVENTION

As embodied herein, an apparatus useful in accomplishing the above objects includes an antenna platform pivotally supported on a fixed stand through gimbal means associated with the stand. The gimbal means comprises at least two pivot axes perpendicular to each other. Preferably the gimbal means is associated with the stand in a manner such that the pivot axes are maintained in fixed relation to the vessel, parallel to the pitch and roll axes thereof, respectively. At least two gyro means, each including a flywheel and a flywheel drive motor, are suspended from the platform. The at least two gyros are pivotally supported on gyro support axes which are perpendicular to one another. Each of the gyros is rotatable about a gyro azimuth axis, and gyro azimuth drive means are provided for driving the gyro means about their respective gyro azimuth axes responsive to azimuth information to stabilize the platform.

DESCRIPTION OF A PREFERRED EMBODIMENT

Referring to the Figures, tracking antenna 12 is supported on platform 10. The platform is pivotally supported through gimbal means to fixed stand 15, which is in turn secured to a portion of the ship or vessel.

Figure 2:
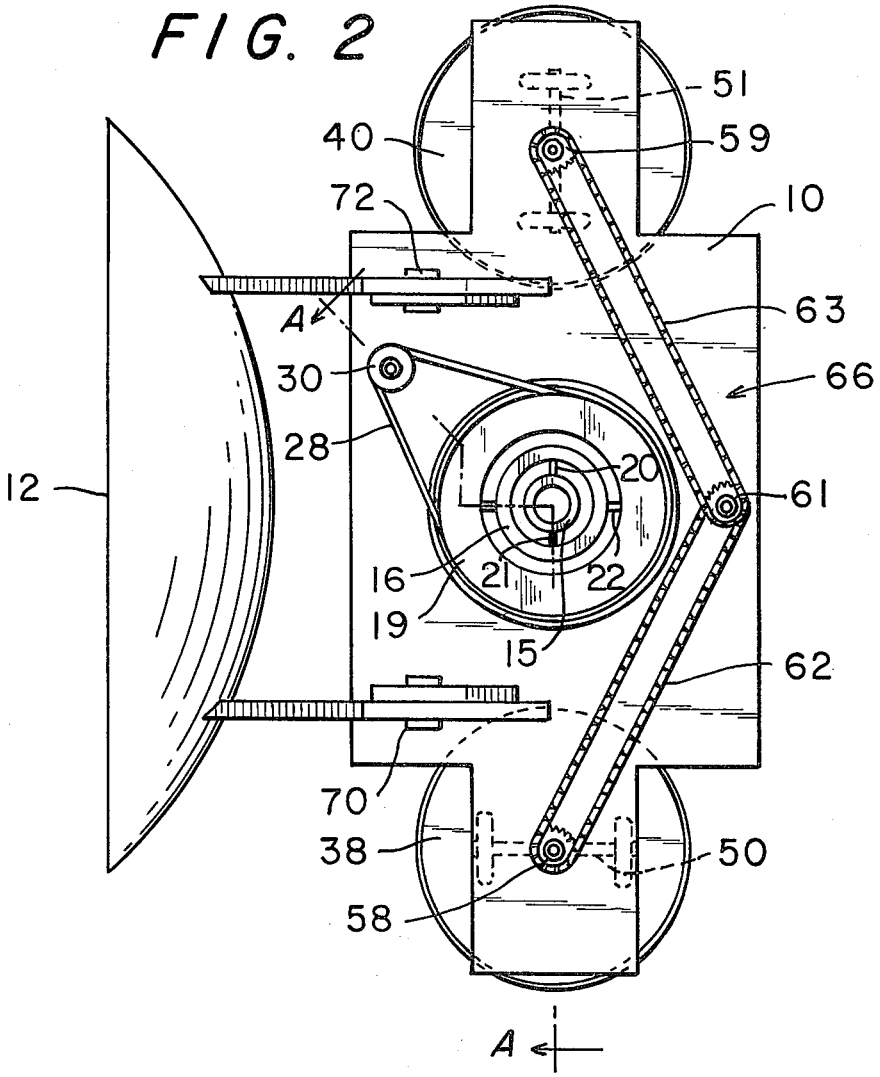
FIG. 2 is a plan view of the apparatus of FIG. 1.
Figure 3:
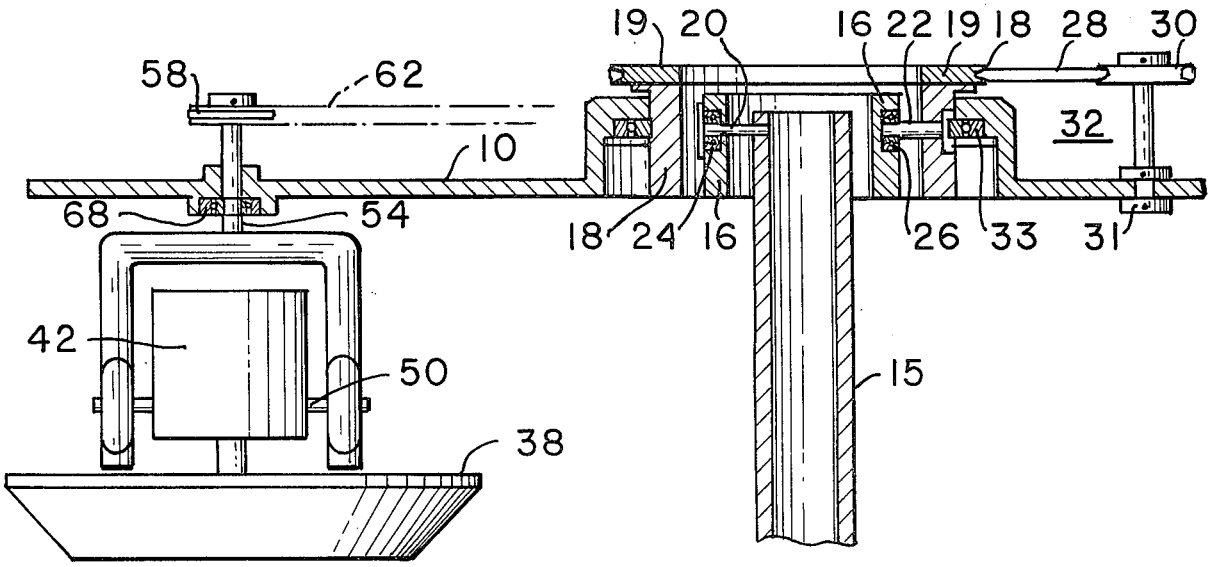
FIG. 3 is a partial cross-sectional view of the stabilization system of FIGS. 1 and 2, taken along line A—A of FIG. 2.

As shown in FIGS. 2 and 3, the gimbal means comprises an inner gimbal ring 16 and an outer gimbal ring 18. Inner ring 16 is pivotally supported on fixed stand 15 by means of inner gimbal axes 20 and 21. Bearings 24 facilitate pivoting of the ring about these axes. Additionally, the inner gimbal ring 16 is pivotally fixed to outer gimbal ring 18 by means of outer gimbal axes 22 and 23 and bearing means 26. Platform 10 is supported on outer gimbal ring 18. Thus, the platform is free to pivot or tilt about mutually perpendicular horizontal axes 20-21 and 22-23.

Figure 4:
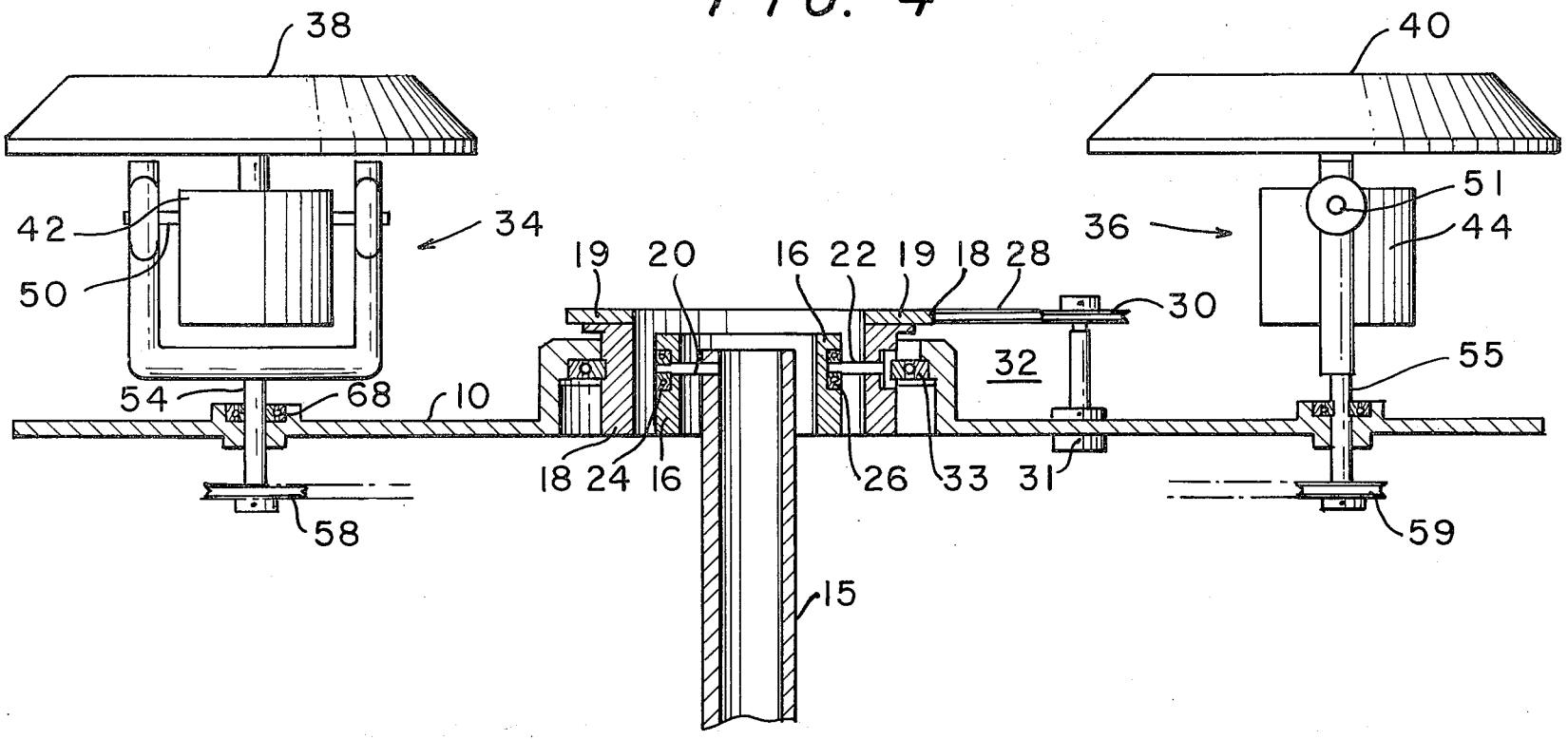
FIG. 4 is a sectional view of a second embodiment of the present invention.

Platform 10 is rotatably mounted on the outer gimbal ring 18 by means of support bearing 33 (FIG. 4). Drive motor 31 of the platform azimuth drive means 32 is fixed to the platform 10. Sprocket 19, fixed to outer gimbal 18, is connected through chain or belt means 28 to the sprocket 30 of the platform azimuth drive means. Thus, drive means 32 may rotate the platform in a horizontal plane around its azimuth axis.

Satellite tracking antennas normally comprise means to adjust the elevational position of the antenna by pivoting the antenna about mounts 70, 72. As such means do not form part of the present invention, they are not shown in the drawings nor further discussed in the specification for the sake of clarity.

In order to stabilize the platform and the associated antenna, the apparatus is designed such that its center of gravity lies beneath the plane containing gimbal pivot axes 20-21 and 22-23. Also, at least two gyro means 34 and 36 are suspended from the platform 10 with their respective gyro azimuth axes vertical and normal to the plane of the platform.

The respective gyro means 34 and 36 include flywheels 38 and 40 as well as drive motors 42 and 44. Motors 42 and 44 rotate the flywheels at high speed in opposite directions. Suspension means 54 and 55 support the respective flywheels 38 and 40. The suspension means includes gyro support axes 50 and 51 pivotally supporting the gyros. The support axes 50 and 51 are positioned so as to be perpendicular to one another. Gyro means 34 and 36 have respective centers of gravity below the support axes 50 and 51.

Gyro azimuth drive means 66 is provided in the present stabilization system for driving the suspension means 54 and 55 and associated gyros 34 and 36 rotationally about their respective gyro azimuth axes. In the presently illustrated embodiment, the gyro azimuth drive means 66 includes drive motor 60 and sprocket 61. Sprocket 61 is connected through chains 62 and 63 to gyro sprockets 58 and 59 affixed to respective gyro suspension means 54 and 55. Since gyro suspension means 54 and 55 are rotationally supported on the platform by means of bearings 68, the gyros can rotate about their respective azimuth axes while maintaining support axes 50 and 51 perpendicular to one another.

Initially, antenna 12 is positioned to receive signals from a satellite in stationary earth orbit. The antenna will track the satellite in order to continually receive signals therefrom. To accomplish this, it is necessary to rotate the antenna about the vertical axis of stand 15, coinciding with the platform azimuth axis, in order to compensate for changes in this ship's heading.

Drive motor 31 is responsive to signals from the ship's compass which detects changes in the ship's heading. As the ship's direction changes, stand 15 and the gimbal means rotate along with the ship about the azimuth axis. Drive motor 31 of platform drive means 32 will automatically rotate platform 10 about the azimuth axis in an opposite direction in order to compensate for the change in the ship's heading. Thus, so long as the antenna is tracking a statellite, the antenna 12, platform 10, and gyros 34, 35 will be maintained in a fixed directional orientation.

During tracking of a satellite, as described in the preceding paragraph, the pivot axes 50, 51 of the gyros are maintained in a fixed direction. Consequently, even if pitching or rolling motion should occur while the ship is changing direction, there will be no resulting precession of either gyro and no undesirable horizontal torque components, as previously described. At the same time, the gimbal pivot axes 20-21 and 22-23 rotate with the ship, and are thus maintained parallel to the pitch and roll axes, respectively. Since the pivot axes are parallel to the pitch and roll axes, respectively, simple pitching or rolling motion can readily be accommodated by one or the other of the pivot axes. This minimizes the likelihood that motion of the ship will be transferred to the platform by frictional forces generated within the bearings associated with the pivot axes.

The preceding discussion of the mode of operation of the present apparatus described those situations in which the directional orientation of the platform remains constant despite changes in the ship's heading. At certain times, it is necessary to alter the directional orientation of the platform regardless of the ship's motion or direction. For example, if, in the course of travel, tracking of one satellite is to terminate and tacking of another satellite is to commence, it will typically be necessary to rotate the platform to reposition the antenna. Also, an electrical connector generally extends between the antenna and communication equipment aboard the ship. If the platform were to rotate continually in a single direction, the cable would become wrapped about stand 15. In order to avoid this, it is sometimes necessary to rotate the platform in a direction tending to unwind the cable from the support stand. In conventional stabilization systems, if the platform is rotated in such manner as to alter its directional orientation, the gyro support axes 50 and 51 will also rotate. If this occurs during pitching and rolling motion of the ship, undesirable torque components will be generated, as previously described, tending to unbalance the platform.

The present invention overcomes these difficulties associated with prior art devices by provision of the gyro azimuth drive means. At times when the platform is being rotated about its azimuth axis so as to alter its directional orientation, drive motor 60 of the gyro azimuth drive means is actuated to rotate the gyros about their individual azimuth axes. The gyros are rotated at a speed equal to, but in a direction opposite to, the rotation of the platform. Thus, despite the alteration in the position of the platform, the gyro pivot axes 50 and 51 are maintained perpendicular to each other and in a fixed directional orientation. Thus, the undesirable torque components tending to unbalance the platform cannot develop.

Gyro azimuth drive motor 60 may be made automatically responsive to an auxiliary gyro compass associated with the platform (not shown), sensing changes in the directional orientation of the platform. If, in order to prevent wrapping of the above-described cable about stand 15, a rotation limiting switch is associated with the platform and the stand, motor 60 may be responsive to the rotation limiting switch in order to activate the gyro azimuth drive means. Motor 60 might also be activated manually when the antenna is caused to terminate tracking of a first satellite and the platform is rotated to enable the antenna to track a second satellite.

Figure 1:
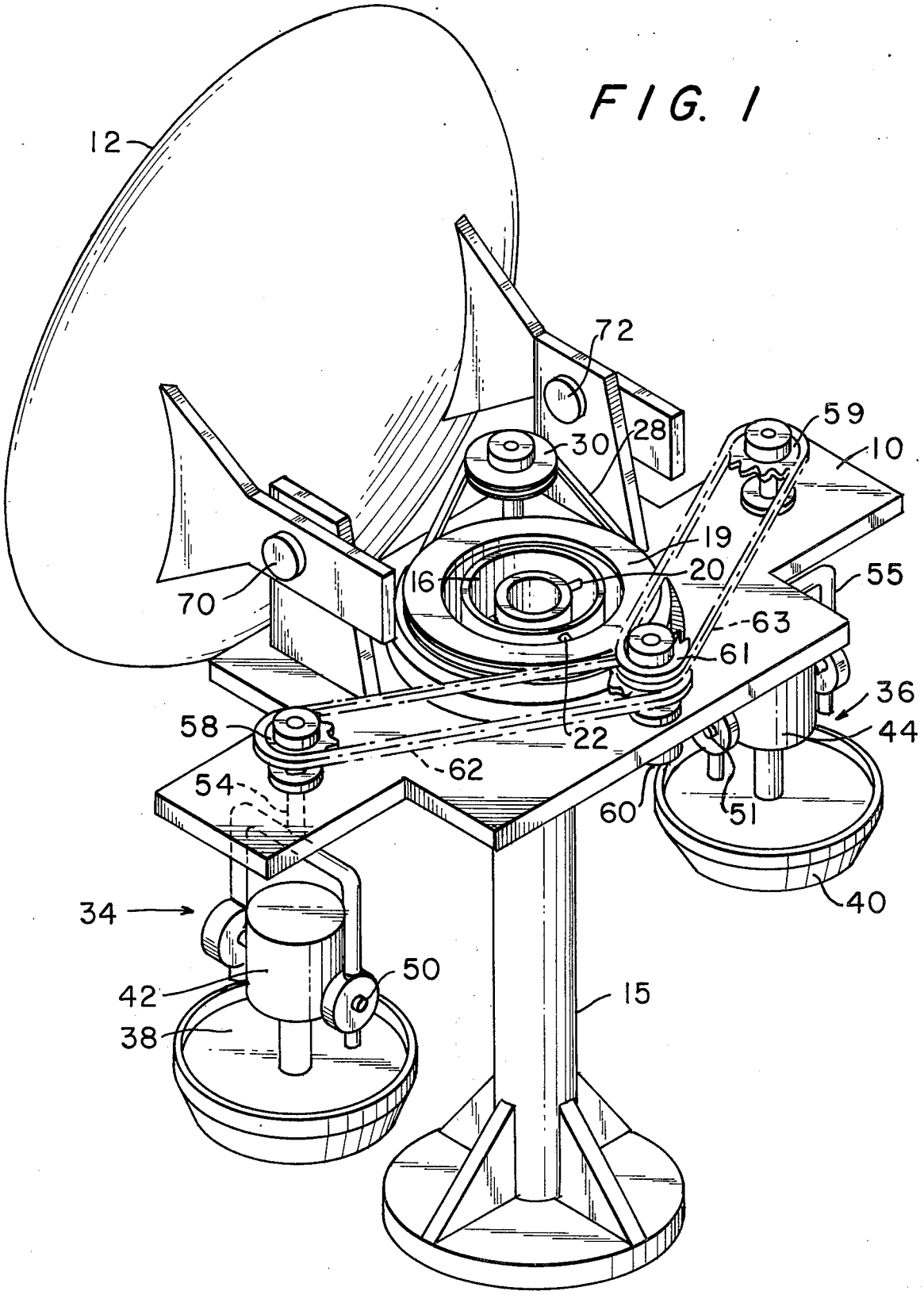
FIG. 1 is a perspective view illustrating a first embodiment of the antenna stabilization system according to the present invention.

FIG. 4 is a partial sectional view of a second embodiment of the present invention. As discussed above with respect to FIGS. 1-3, platform 10 is pivotally mounted on stand 15. Elements discussed previously with respect to FIGS. 1-3 are indicated by corresponding reference numerals.

In the embodiment of FIG. 4, gyros 34 and 36 are suspended above the platform 10, rather than below. Gyros 34 and 36 comprise flywheels 38 and 40, as well as motors 42 and 44, respectively. In this embodiment, the flywheels are positioned above their respective drive motors. Gyro 34 is pivotally mounted on gyro support axis 50 while gyro 36 is pivotally mounted on gyro support axis 51. The center of gravity of each gyro lies below its respective support axis.

The FIG. 4 embodiment also comprises gyro azimuth drive means, as discussed above, including sprockets 58 and 59. Gyros mounted in the manner illustrated in FIG. 4 will stabilize the platform in the manner previously discussed with respect to FIGS. 1-3.

In the embodiments shown and described, the gyro azimuth drive means includes a single motor 60 for driving two gyros 34 and 36. It is, of course, possible to achieve the same result by using individual motors for driving the suspension means 54 and 55, respectively. It is also possible to drive the suspension means 54 and 55 by a suitable clutch connection with platform drive means 32.

The apparatus of the present invention is capable of stabilizing a pivotable platform aboard a movable vessel despite pitching and rolling motion of the vessel, and despite changes in the orientation of the vessel or of the platform. The present invention provides means to prevent undesirable gyroscopic precession tending to unbalance the stabilized platform. Simultaneously, the apparatus of the present invention maintains the gimbal pivot axes parallel to the pitch and roll axes of the movable vessel, thus minimizing or eliminating the possibility that movements of the vessel will be transmitted to the platform by frictional forces.

While the invention has been disclosed with reference to the accompanying drawings, we do not wish to be limited to the details shown and described herein as obvious modifications may be made by those of ordinary skill in the art.

What is claimed is:

1. A passive stabilization system comprising;

a fixed stand;

gimbal means associated with said stand;

a platform pivotally mounted on said stand by said gimbal means;

at least two gyros, each including a flywheel and a drive motor for said flywheel;

at least two suspension means suspending respective ones of said gyros from said platform and having a gyro azimuth axis normal to said platform, said at least two gyros being mounted pivotally about respective gyro support axes which are perpendicular to one another; and gyro azimuth drive means for driving said at least two suspension means about their individual gyro azimuth axes while maintaining the individual axes in their relative angular relationship in response to azimuthal movement of said platform.

2. A passive stabilization system as in claim 1, wherein sai gyro azimuth drive means comprises at least one motor for driving all said suspension means about said gyro azimuth axes.

3. A passive stabilization system as in claim 1, wherein said gimbal means includes an inner gimbal and an outer gimbal;

platform drive means associated with said platform and said outer gimbal for driving said platform about its azimuth axis;

wherein said gyro azimuth drive means drives said suspension means about the gyro azimuth axes in a direction opposite to movement of said platform.

4. A passive stabilization system as in any one of claims 1, 2, and 3, wherein an antenna is supported on said platform, said stand is fixed to a movable vessel, and said stabilization system maintains a desired orientation of said antenna during movement of said vessel.

5. A passive stabilization system for use on a vessel comprising:

a fixed stand secured to said vessel;

gimbal means associated with said stand, said gimbal means comprising at least two pivot axes perpendicular to each other and mounted on said stand in a position which is fixed in relation to said vessel;

a platform pivotally mounted on said stand by said gimbal means;

at least two gyros associated with said platform, each including a flywheel and a drive motor for said flywheel, said gyros being mounted pivotally about respective gyro support precession axes which are perpendicular to each other;

platform drive means for driving said platform and said gyros associated with said platform about said gimbal means and for maintaining the orientation of said platform in a constant directional orientation despite changes in orientation of said vessel; and gyro azimuth drive means including means coupling said gyros and maintaining their precession axis perpendicular to one another in response to azimuthal movement of said platform.

6. A passive stabilization system as in claim 5 further comprising:

suspension means suspending the individual ones of said gyros from said platform, each of said suspension means having a gyro azimuth axis normal to said platform; and wherein said azimuth drive means drives said suspension means about their gyro azimuth axis.

7. A passive stabilization system as in claim 5 or 6, wherein said pivot axes are mounted on said stand with at least one pivot axis fixed in a position parallel to the pitch axis of said vessel and with at least one other pivot axis fixed in a position parallel to the roll axis of said vessel.

8. A passive stabilization system as in claim 5, further comprising:

suspension means suspending the individual ones of said gyros from said platform, each said suspension means having a gyro azimuth axis normal to said platform; and wherein said gyro azimuth drive means drives said suspension means about the respective gyro azimuth axes in a direction opposite to rotation of said platform.

9. A passive stabilization system as in any one of claims 5, 6, and 8, further comprising an antenna supported on said platform and jointly rotatable with said platform and said gyros as associated therewith.

10. A passive stabilization system comprising:

a stand fixed on a movable base;

gimbal means associated with said stand;

a platform pivotally mounted on said stand by said gimbal means and rotatable with the changing azimuth of said base;

at least two gyros, each including a flywheel and a drive motor for said flywheel;

suspension means suspending the individual ones of said gyros from said platform and having a gyro azimuth axis normal to said platform, said gyros being mounted pivotally about respective gyro support axes which are perpendicular to one another; and gyro azimuth drive means for driving said suspension means about their individual gyro azimuth axes while maintaining their gyro support axes in their relative angular relationship and maintaining said gyro azimuth axes normal to said platform during the driven azimuth rotation of said platform.

* * * * *